United States Patent [19]

Tsuyoshi et al.

[11] Patent Number: 4,832,580

[45] Date of Patent: May 23, 1989

[54] FLUID PRESSURIZING DELIVERY PUMP SYSTEM

[75] Inventors: Nagata Tsuyoshi, Osaka; Nakamune Kenichi, Nara; Fujita Katsuto, Osaka, all of Japan

[73] Assignee: Sunstar Engineering Inc., Osaka, Japan

[21] Appl. No.: 108,544

[22] Filed: Oct. 14, 1987

[30] Foreign Application Priority Data

Oct. 23, 1986 [JP] Japan ..... 61-252185

[51] Int. Cl.[4] ..... F04B 23/06; F04B 39/08; F04B 45/02

[52] U.S. Cl. ..... 417/290; 417/317; 417/412; 417/473; 417/505

[58] Field of Search ..... 417/290, 303, 307, 472, 417/473, 505, 533, 538, 539, 412, 317

[56] References Cited

U.S. PATENT DOCUMENTS

| | | | |
|---|---|---|---|
| 3,376,868 | 4/1968 | Mondiadis | 417/472 |
| 4,090,818 | 5/1978 | Hope et al. | 417/473 |
| 4,321,014 | 3/1982 | Eburn, Jr. et al. | 417/317 X |
| 4,436,230 | 3/1984 | Hofmann | 417/539 X |
| 4,493,614 | 1/1985 | Chu et al. | 417/415 X |
| 4,545,736 | 10/1985 | Walton | 417/290 X |
| 4,589,825 | 5/1986 | Schmidt | 417/290 |
| 4,700,205 | 10/1987 | Rich et al. | 417/472 X |
| 4,725,207 | 2/1988 | Buckwald | 417/412 |

FOREIGN PATENT DOCUMENTS

| | | | |
|---|---|---|---|
| 2071786 | 9/1981 | United Kingdom | 417/307 |

*Primary Examiner*—Leonard E. Smith
*Assistant Examiner*—Eugene L. Szczecina, Jr.
*Attorney, Agent, or Firm*—Koda and Androlia

[57] ABSTRACT

Provided are a pair of pumps, each of which comprises a bellows having an intake inlet and a discharge outlet, a reciprocating drive means for contraction and expansion movements of the bellows, and a couple of electro-magnetic on-off valves disposed respectively in the intake inlet side and discharge outlet side of the bellows, so that, during the contracting motion of the bellows, the electro-magnetic on-off valve in the intake inlet side becomes closed while the electro-magnetic on-off valve in the discharge outlet side becomes open, and during the expanding motion of the bellows, the electro-magnetic on-off valve in the intake inlet side becomes open while the electro-magnetic on-off valve in the discharge outlet side becomes closed. The paired pumps perform the discharge motions alternately. The discharge outlets of the pumps at their ends are fluidly connected via a directional valve with a discharging gun. In case the gun remains unactivated for a certain period of time, the directional valve will operate so that the flow of fluid delivered from the pumps can circulate.

2 Claims, 3 Drawing Sheets

FLUID PRESSURIZING DELIVERY PUMP SYSTEM

BACKGROUND OF THE INVENTION

The present invention relates to a pump system for pressurizing delivery of a fluid such as paint, primer, adhesive, or the like.

It is commonly known to use a gear pump in such a fluid pump system although a life of the gear pump lasts short due to wearing. The problem may arise such that, as having to rotate at low speeds with the use of a relatively small volume of fluid, the gear pump produces heavy leakage loss of the fluid in its inside thus providing lower efficiency. Additionally, the gear pump which comprises a great number of components have a tendancy to cause faults.

It is an object of the present invention, in view of the aforesaid points, to provide a pump system having a couple of bellows instead of a gear pump.

It is another object of the present nvention to improve the operation of a bellow pump as generally termed.

Other objects of the present invention will become apparent from the following description taken in conjunction with the accompanying drawings.

DETAILED DESCRIPTION

Figure 1:
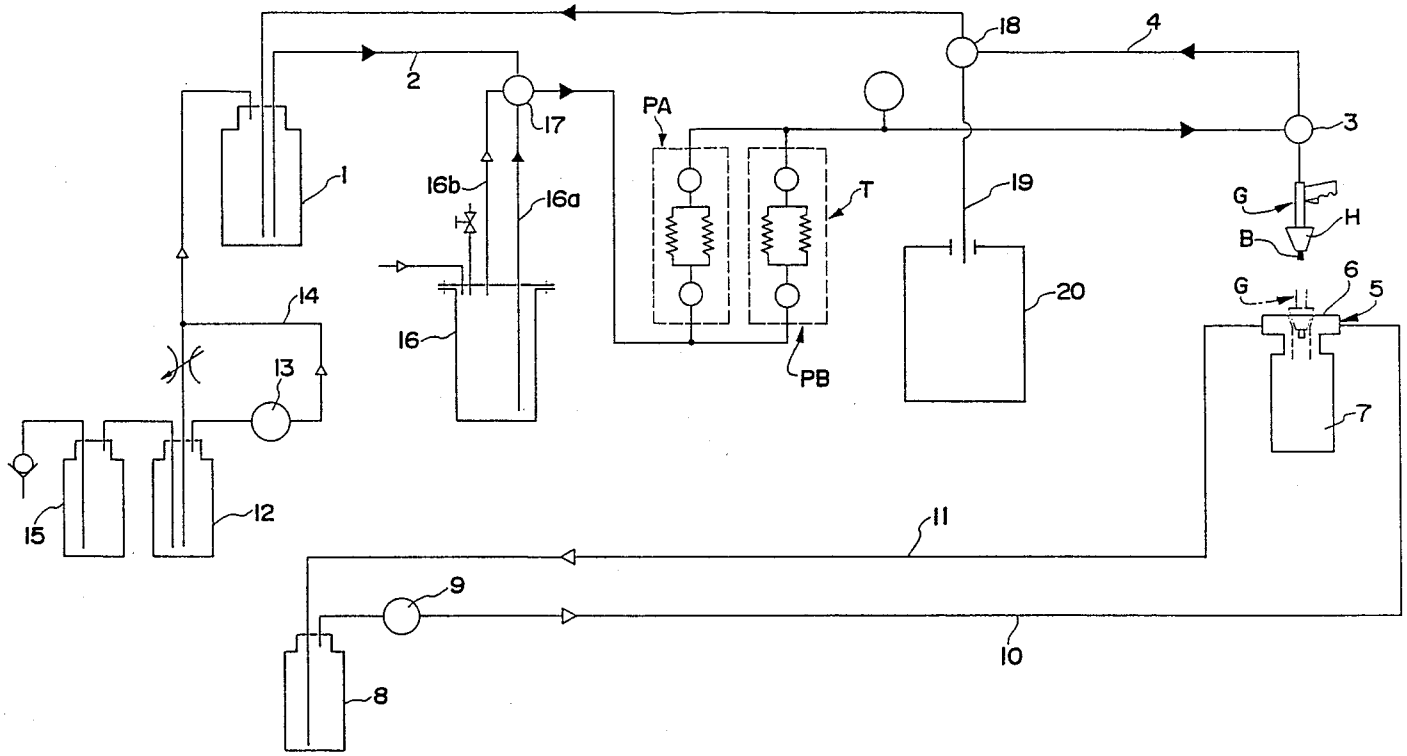
FIG. 1 is a schematic view showing the arrangement of a painting apparatus including a pump system of the present invention.

As shown in FIG. 1, the numeral 1 is a primer reservoir which contains a volume of primer (coating agent), the primer rservoir 1 being fluidly communicated via a conduit 2 with a pump system T according to the present invention. The pressured flow of the primer from the pump system T is delivered via a three-way electromagnetic valve 3 to a coating gun G and a conduit 4 which is fluidly connected with the primer reservoir 1. The numeral 5 is a gun stand, which is to accept a head portion H of the gun G, comprising a gun hed support 6 and a drain reservoir 7. Within the gun head support 6, introduced through a mist supply pump 9 is a mist of solvent which is to prevent hardening of a brush B mounted to the tip of the gun G, the solvent mist being delivered through a conduit 10 from a reservoir 8 before returning through a conduit 11 to the rservoir 8 which contains a liquid solvent for prevention of brush hardening. The numeral 12 is a reservoir which contains a liquid solvent for prevention of primer hardening. The liquid solvent for prevention of primer hardening as a mist of vapour is delivered by a mist supply pump 13 thus to pass from the rservoir 12 via conduit 14 into the primer rservoir 1, which prevents the primer in the reservoir 1 from hardening. The resrvoir 12 for primer hardening preventing solvent is provided with the air dried previously in a drying agent reservoir 15. The numeral 16 is a reservoir for a cleaning solvent with which the interior of two pumps PA, PB and of the conduits 2, 4 is cleaned down. For cleaning operation, a volume of air is supplied at a pressure to the reservoir 16 thus to discharge a mist and liquid of the cleaning solvent from the rservoir 16 through conduits **16*a* and 16*b* and deliver it via a valve cock 17 from the conduit 2 side to the conduit 4 side. A cleaning waste liquid will drain off through a drain conduit 19 which extends from a switch cock 18 of the conduit 4 and finally exit towards a rservoir 20**.

Figure 2:
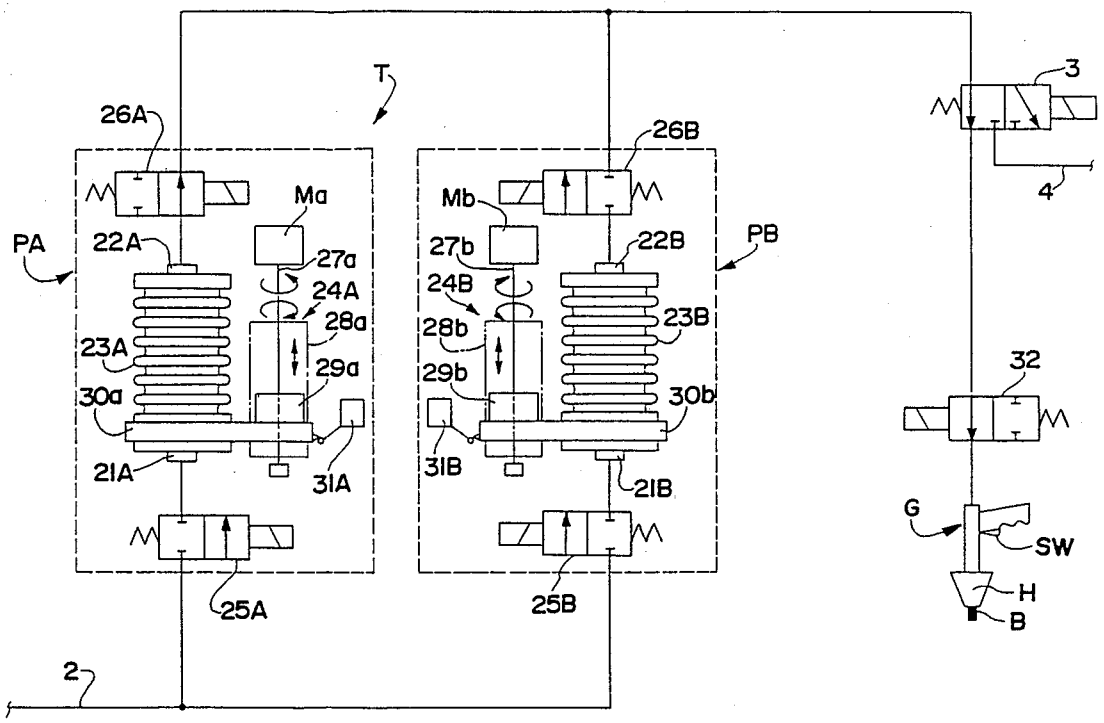
FIG. 2 is a schematic view illustrating in detail the pump system of FIG. 1.
Figure 3:
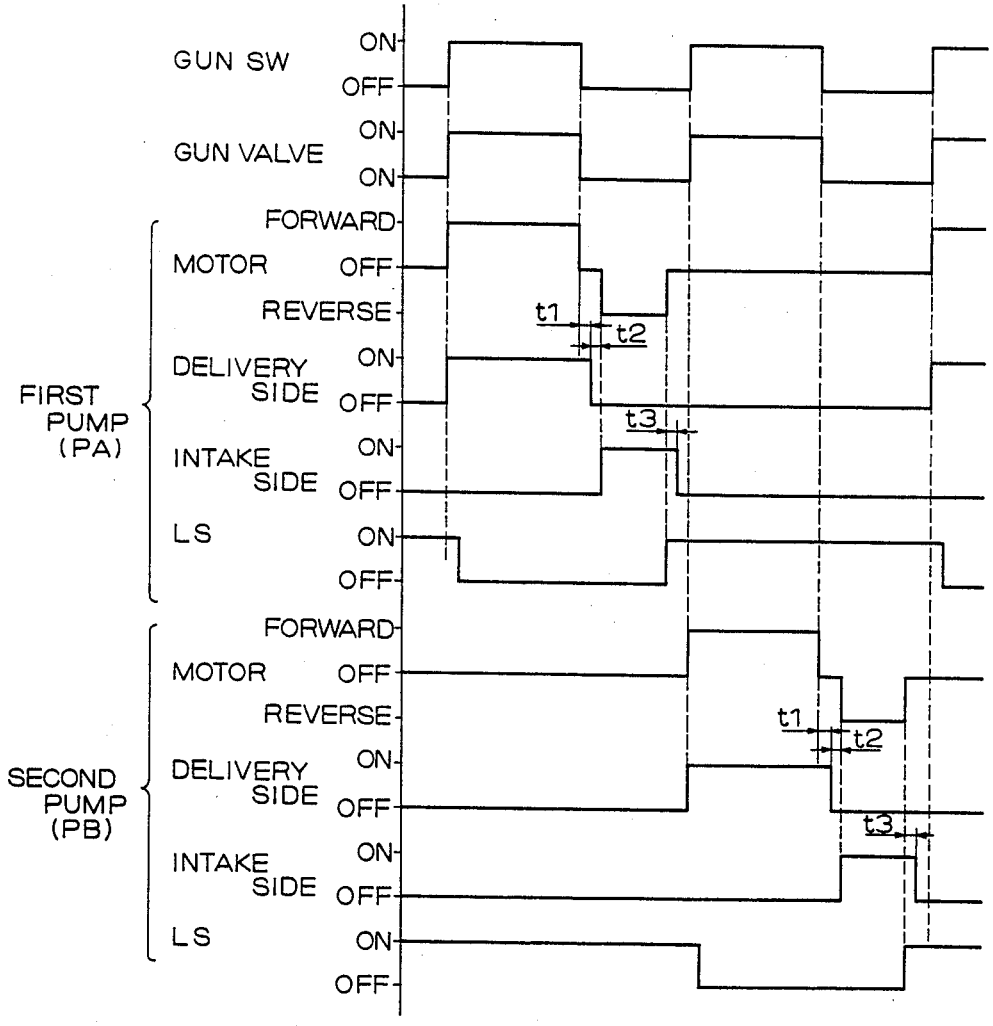
FIG. 3 is a time chart showing an operative condition of the pump system.

The aforesaid pump system T will be described in conjunction with FIGS. 2 and 3. The pump system T is provided with a pair of the first and second pumps PA, PB as shown in FIG. 2. The pumps PA and PB comprise respectively; bellows 23A and 23B, which are monolithicly fabricated with synthetic resin such as Teflon or the like, having intake inlets 21A, 21B and discharge outlets 22A, 22B, reciprocating drive means 24A and 24B for contraction and expansion movements of their respective bellows 23A and 23B; and electromagnetic on-off valves 25A, 25B and 26A, 26B being arranged at the intake inlet side and the discharge outlet side in an orderly manner, and thus, can be controlled so that, during the contracting motion of the bellows 23A or 23B, the intake side valve 25A or 25B become closed while the delivery side valve 26A or 26B become open and, during the expanding motion of the bellows 23A or 23B, the intake side valve 25A or 25B become open while the delivery side valve 26A or 26B become closed. In the pump system T, the discharging motions of the first pump PA and second pumps PB are controlled to effect alternately. The reciprocating drive means 24A and 24B comprise respectively; ball screw shafts **27*a* and 27*b* being driven in the forward and reverse directions by pulse motors Ma and Mb; ball nut members 29*a* and 29*b* being in thread engagement with the ball screw shafts 27*a* and 27*b* and, in addition, non-rotatably held by guide means 28*a* and 28*b* so as to move reciprocatingly in the axial directions according to the forward and reverse rotating movements of the ball screw shafts 27*a* and 27*b*; and joining members 30*a* and 30*b* with which the ball nut members 29*a*, 29*b* and the bellows 23A, 23B are joined respectively. The numerals 31A and 31B shown in the figure are limit switches Ls which detect the ball nut members 29*a* and 29*b* at their respective lower strike ends thus to stop the motors Ma and Mb. For operations of the coating gun G, when a switch SW mounted to a grip portion thereof is depressed, a electro-magnetic on-off valve 32** for the gun becomes open and thus, the primer fluid will be discharged through the brush B mounted to the discharge outlet in the tip of the head H.

Futhermore, the performance of the pump system PST relative to the operation of the gun G will be described in conjunction with FIG. 3. While the ball nut member **29*a* of the reciprocating drive means 24A in the first pump PA rests at the lower limit position (accordingly, with the bellows 23A remaining expanded), the limit switch 31A remains engaged through the striking action of the nut member 29*a* so as to cease the motor Ma. Meanwhile, the second pump PB is in the same state as the first pump PA. When the switch SW of the gun G is depressed, the gun valve 32 becomes open thus to rotate the motor Ma of the first pump PA (in the forward direction). Accordingly, as the ball screw shaft 27*a* rotates, the ball nut member 29*a* moves upward (forward) form its lower limit position thus to cause the contracting motion of the bellows 23A which commences from its expanded state. While the nut member 29*a* moves upward, the limit switch 31A will be in its off position. Additionally, through the switch-on motion of the gun switch SW, the intake inlet side valve 21A in the first pump PA becomes closed while the discharge outlet side valve 26A becomes open. Accordingly, as the bellows becomes contracted, a volume of the primer provided therein will be discharged at a pressure and delivered through the tip portion of the gun G. When the gun switch SW, which has remained switched on for a specific period of the coating operation, is switched off, the motor Ma in the first pump PA stops and then, after a very short period (t1−t2) of time, will start rotating in the reverse direction. Relatively, when the motor Ma stops, the discharge outlet side valve 26A does not close up instantly but will be closed after a specific period of time (t1) as shown in FIG. 3. This is arranged for permitting the remaining deflection in the bellows 23A resulted from the resilient properties thereof. Within a specific time (t2) after the discharge outlet side valve 26A has been closed, the motor Ma starts rotating in the reverse direction and simultaneously, the intake inlet side valve 25A becomes open. Then, the ball nut member 29***a* moves downward as the motor Ma rotates in the reverse direction, whereby the bellows 23A becomes expanded. During the expanding motion of the bellows 23A, a negative pressure is produced within the bellows 23A so that the primer fluid in the intake side conduit can be introduced thereinto. The motor Ma turns at a faster speed during its reverse rotating movement than during its forward rotating movement so as to permit the bellows 23A to become quicker in the expanding motion than in the contracting motion and thus, to return fast. When the ball nut member 29*a* reaches its lower limit position, the limits switch 31A will be actuated thus to stop the motor Ma. Then, within a specific period (t3) after the motor Ma has stopped, the intake inlet side valve 25A becomes closed. Accordingly, when the gun switch SW is depressed for starting again the coating operation, the gun valve 32 becomes open once more and, at this time, while the motor Ma in the first pump PA remains resting, the motor Mb in the second pump PB starts rotating (n the forward direction). Afterwards, the second pump PB will perform the same operation as the first pump PA described perviously so that the fluid primer in the conduit 2 can be delivered at a pressure and discharged through the tip portion of the gun G in the operation shown in FIG. 3. In such manner, every time the gun G is actuated for use, the first and second pumps PA, PB will perform a seriies of the motions alternately.

According to the pump system set forth above, the pumping operation can be effected satisfactorily with the use of a relatively small volume of discharging fluid and additionally, a constant delivery of the fluid can be made with accuracy due to no leakage of the fluid which is common with a gear pump,. which will improve the efficiency. Because the bellows is not involved in wornout and breakage resulting from the mutual mechanical contacts at the teeth of gears, the pump will stand long use and produce fewer faults. Particularly, according to the pump system of the present invention, a pair of the aforesaid pumps are provided so as to perform the delivery motions alternately, which gives an advantage such that a constant stream of the fluid can be discharged and additionally, if one of the two pumps is out of order for use, the other one will yet be available to continue the operation.

In case that the gun G is not used for a period of more than one hour, the three-way electro-magnetic valve 3 is actuated so that the conduit 2 can be fluidly connected with the conduit 4 and then, the pump system T provides a circulating movement of the primer, whereby the primer in the conduit 2 is prevented from hardening. The gun G may be mounted to the distal end of the arm of a robot for automatic operations of the gun G. Furthermore, an automatic operation of the complete pump system according to the present invention can be feasibly effected.

What is claimed is:

1. A fluid pressurizing delivery pump system comprising a pair of pumps and a spray gun, wherein each of said pumps comprises:

a bellow fabricated monolithically from a soft synthetic resin and having an intake inlet and a discharge outlet;

electromagnetic ON-OFF valves disposed respectively in the intake inlet side and discharge outlet side of said bellow; and a reciprocating drive means comprising a motor, a screw driven in opposite directions by said motor, and a nut which fits on said screw and is coupled to one end of said bellow, said nut moving back and forth in accordance with rotation of said screw to expand and contract said bellow; and in which:

during the contracting motion of said bellows, the electromagnetic ON-OFF valves in the intake inlet sides are closed while the other electromagnetic ON-OFF valves in the discharge outlet sides are opened to discharge fluid therefrom; and during the expanding motion of said bellows, the electromagnetic ON-OFF valves in the intake inlet sides are opened while the other electromagnetic ON-OFF valves in the discharge outlet sides are closed to intake fluid therein; and the intake inlets of said pair of pumps are connected to each other and are further connected to a tank containing fluid, and the exhaust outlets of said pumps are connected to each other and are further connected to said spray gun; and said spray gun comprises:

an electromagnetic ON-OFF gun valve which discharges and stops fluid; and a gun switch which turns on and off said electromagnetic ON-OFF gun valve; wherein when said gun switch is turned on, said electromagnetic ON-OFF gun valve is opened and motors of said pumps are controlled to rotate forward;

when said gun switch is turned on and off repeatedly, discharge of fluid by said gun is intermittently performed;

while one discharge of said gun is being performed, the motor of only one of said pair of pumps rotates forward and continuously performs discharge;

when said gun performs a next discharge, the motor of other pump is controlled to rotate forward, resulting in that every time a discharge by said gun is performed, the motor of each of said pair of pumps rotates forward alternately so that the discharge is performed alternately; and when said gun switch is turned off, said motors are simultaneously turned off, and a certain period of time thereafter, said electromagnetic ON-OFF valves of said pumps are controlled to turn off.

2. A fluid pressurizing delivery pump system comprising a pair of pumps and a spray gun wherein:

each of said pumps comprises:

a bellow fabricated monolithically from a soft synthetic resin and having an intake inlet and a discharge outlet;

electromagnetic ON-OFF valves disposed respectively in the intake inlet side and discharge outlet side of said bellow; and a reciprocating drive means comprising a motor, a screw driven in opposite directions by said motor, and a nut which fits on said screw and is coupled to one end of said bellow, said nut moving back and forth in accordance with rotation of said screw to expand and contract said bellow; and in which:

during the contracting motion of said bellows, the electromagnetic ON-OFF valves in the intake inlet sides are closed while the other electromagnetic ON-OFF valves in the discharge outlet sides are opened to discharge fluid therefrom; and during the expanding motion of said bellows, the electromagnetic ON-OFF valves in the intake inlet sides are opened while the other electromagnetic ON-OFF valves in the discharge outlet sides are closed to intake fluid therein;

the intake inlets of said pair of pumps are connected to a tank containing fluid; and the discharge outlets of said pair of pumps are selectively connected to said spay gun or tank through a change direction valve; and said spray gun comprises:

an electromagnetic ON-OFF gun valve which discharges and stops fluid; and a gun switch which turns on and off said electromagnetic ON-OFF gun valve; wherein when said gun switch is turned on said electromagnetic ON-OFF gun valve is opened, and motors of said pumps are controlled to rotate forward; and the discharge outlets of said pumps are controlled to connect with said spray gun by said change direction valve;

when said gun switch is turned on and off repeatedly, discharge of fluid by said gun is intermittently performed;

while one discharge of said gun is being performed, the motor of only one of said pair of pumps rotates forward and continuously performs discharge;

when said gun performs a next discharge, the motor of other pump is controlled to rotate forward, resulting in that every time a discharge by said gun is performed, the motor of each of said pair of pumps rotates forward alternately so that the dischrge is performed alternately;

when said gun switch is turned off, said motors are simultaneously turned off, and a certain period of time thereafter said electromagnetic ON-OFF valves of said pumps are controlled to turn off; and when said spray gun does not discharge liquid for over certain period of time, the discharge outlets of said pumps are connected to said tank by said change direction valve and motors of said pumps are rotated to perform discharge so that the liquid in the tank is caused to circulate and is prevented from being solidified.

* * * * *

UNITED STATES PATENT AND TRADEMARK OFFICE

CERTIFICATE OF CORRECTION

PATENT NO. : 4,832,580

DATED : May 23, 1989

INVENTOR(S) : Tsuyoshi Nagata, et. al.

It is certified that error appears in the above-identified patent and that said Letters Patent is hereby corrected as shown below:

Column [75] Inventors: Change "Nagata Tsuyoshi, Osaka; Nakamune Kenichi, Nara; Fujita Katsuto, Osaka, all of Japan" to --Tsuyoshi Nagata, Osaka; Kenichi Nakamune, Nara; Katsuto Fujita, Osaka, all of Japan--

Signed and Sealed this

Twenty-seventh Day of February, 1990

*Attest:*

JEFFREY M. SAMUELS

*Attesting Officer* *Acting Commissioner of Patents and Trademarks*